US005203549A

United States Patent [19]

Bryson, Sr. et al.

[11] Patent Number: 5,203,549

[45] Date of Patent: Apr. 20, 1993

[54] COLLATOR WITH PRINTER HAVING INCLINED PRINTING PATH AND DISPLACEABLE CONVEYOR BELTS TO EXPOSE PRINTING SURFACE

[75] Inventors: Robert A. Bryson, Sr., Huber Hts.; David F. Christofferson, Englewood; John Hobbs, Troy; Al Baglyos, Huber Hts., all of Ohio

[73] Assignee: AM International Incorporated, Chicago, Ill.

[21] Appl. No.: 805,119

[22] Filed: Dec. 10, 1991

Related U.S. Application Data

[63] Continuation-in-part of Ser. No. 403,127, Sep. 5, 1989.

[51] Int. Cl.[5] ..... B41F 13/54

[52] U.S. Cl. ..... 270/1; 270/58

[58] Field of Search ..... 270/1.1, 52, 54, 58, 270/55, 57

[56] References Cited

U.S. PATENT DOCUMENTS

| | | | |
|---|---|---|---|
| 3,560,988 | 2/1971 | Krick | 346/75 X |
| 4,989,850 | 2/1991 | Weller | 270/1.1 |
| 5,005,815 | 4/1991 | Auksi | 270/1.1 |
| 5,013,019 | 5/1991 | Samuels | 270/1.1 |
| 5,080,337 | 1/1992 | Mayer | 270/1.1 |
| 5,100,116 | 3/1992 | Grausher | 270/1.1 |
| 5,104,105 | 4/1992 | Cote et al. | 270/1.1 |

FOREIGN PATENT DOCUMENTS 3421208 12/1985 Fed. Rep. of Germany ..... 270/1.1

*Primary Examiner*—Edward K. Look
*Assistant Examiner*—John Ryznic
*Attorney, Agent, or Firm*—Tarolli, Sundheim & Covell

[57] ABSTRACT

An improved apparatus is used to feed sheet material to a feed station of a collating conveyor. At the feed station of one embodiment of the invention, a first feed drum engages a leading edge portion of the sheet material and feeds the sheet material toward the collating conveyor. A first feed drum feeds the sheets along an arcuate path to a secondary drum. The secondary feed drum feeds the sheet material from another holder to a secondary conveyor. The secondary conveyor is inclined to a horizontal at an angle lesser than the arcuate path. A printer assembly prints indicia on the sheet material. The printer assembly directs ink toward opposite sides of the sheet material along paths which are skewed at an acute angle relative to the vertical so that particles of ink do not fall back onto ink jet nozzles and clog the nozzles. The conveyor belts are movable transversely to the path of movement of the sheet material through the printer assembly to enable printing to occur at various locations on the sheet material. After printing, the sheets are conveyed along a third path segment which slopes downward away from the printer.

38 Claims, 7 Drawing Sheets

COLLATOR WITH PRINTER HAVING INCLINED PRINTING PATH AND DISPLACEABLE CONVEYOR BELTS TO EXPOSE PRINTING SURFACE

BACKGROUND OF THE INVENTION

This application is a continuation-in-part of application Ser. No. 403,127 filed Sep. 5, 1989 by John Hobbs, Robert A. Bryson, Sr., and Al Baglyos and entitled "Collator With Printer".

The present invention relates to an apparatus for use in feeding sheet material to form groups of sheet material with personalized or other selected information printed thereon.

A known apparatus for forming groups of sheet material with information printed on the sheet material is disclosed in U.S. Pat. No. 4,395,031 issued Jul. 16, 1983 entitled "Apparatus for Printing Books of Signatures and Method for Same". In this known apparatus, groups of sheet material are formed on a saddle type collating conveyor. An ink jet printer is utilized to print personalized information on the sheet material.

When this known apparatus is used to print personalized information on the sheet material, the lines of characters setting forth the personalized information extend parallel to a fold in the sheet material. Thus, as the sheet material is being moved by the collating conveyor in a direction parallel to the fold in the sheet material, each printer head of a plurality of printer heads prints a line of characters which extends parallel to the path of movement of the sheet material. However, preprinted material on the sheet material conventionally extends perpendicular to the fold. Therefore, the personalized information which is printed on the sheet material is disposed in an orientation which is different than the other material printed on the signature.

Another apparatus for forming groups of sheet material with information printed on the sheet material is disclosed in German Patent Application No. 3,421,208 filed Jun. 7, 1984 and published Dec. 12, 1985. This application discloses an apparatus in which groups of sheet material are formed on a saddle type collating conveyor. At one of a plurality of feed stations, an ink jet printer is utilized to print personalized information on sheets of material as the sheets of material are moved toward the collating conveyor.

Another apparatus for forming groups of sheet material with information printed on the sheet material is disclosed in U.S. Pat. No. 5,005,815 issued Apr. 9, 1991 and entitled "Apparatus and Method for Individually Printing Signatures During Delivery to Binding Line Conveyor." This patent discloses an apparatus in which groups of sheet material are formed on a saddle type collating conveyor. At one of a plurality of feed stations, ink jet printers are disposed directly above the collating conveyor and are utilized to print on opposite sides of sheet material as the sheet material is moved straight downwardly toward the collating conveyor. The apparatus disclosed in this patent grips the sheet material with clips on a conveyor chain which moves the sheet material along a path having an inverted U-shaped configuration.

SUMMARY OF THE INVENTION

The present invention provides a sheet material feed assembly which is used to feed sheet material to a main feed drum at a feed station of a collating conveyor. The collating conveyor may be of either the saddle type or flatback type. The sheet material feed assembly is driven by the drive system for the collating conveyor.

The sheet material feed assembly includes a remote or secondary feed drum which feeds sheet material from a holder to a secondary conveyor. The secondary conveyor transports the sheet material through a printer assembly to a sheet material feed assembly at a station of the collating conveyor. The secondary conveyor moves the sheet material to sheet material feed assembly with the leading edge portion of the sheet material in the same orientation that the leading edge portion of the sheet material would be in if the sheet material had been fed from a holder disposed adjacent to the sheet material fed assembly. In one embodiment of the invention, the sheet material feed assembly includes a main feed drum which can be used to feed sheet material either directly from a holder or from the secondary conveyor of the sheet material feed assembly. In another embodiment of the invention, the sheet material feed assembly includes an apparatus which moves the sheet material in the same direction as the collating conveyor.

When sheet material is being moved by the secondary conveyor toward the printer assembly, the leading edge portion of the sheet material is engaged by registration members which align the sheet material with the printer assembly. During movement of the sheet material through the printer assembly, the sheet material moves along an upwardly sloping path. Therefore, ink jet nozzles in the printer assembly direct a flow of ink against the sheet material along a path which is skewed relative to the vertical. This prevents clogging of the ink jet nozzles due to ink falling back onto the nozzles.

The secondary conveyor has belts which are movable transversely to the path of movement of the sheet material through the printer assembly. This enables the printer assembly to be used to print on the sheet material at any desired location. The secondary conveyor feeds the sheet material to the sheet material feed assembly along a path which slopes downwardly toward the sheet material feed assembly. This enables the main feed drum, in one embodiment of the invention, to receive sheet material in the same orientation as in which sheet material is fed from a holder.

BRIEF DESCRIPTION OF THE DRAWINGS

The foregoing and other features of the present invention will become more apparent upon consideration of the following description taken in connection with the accompanying drawings wherein.

DESCRIPTION OF SPECIFIC PREFERRED EMBODIMENTS OF THE INVENTION

Figure 1:
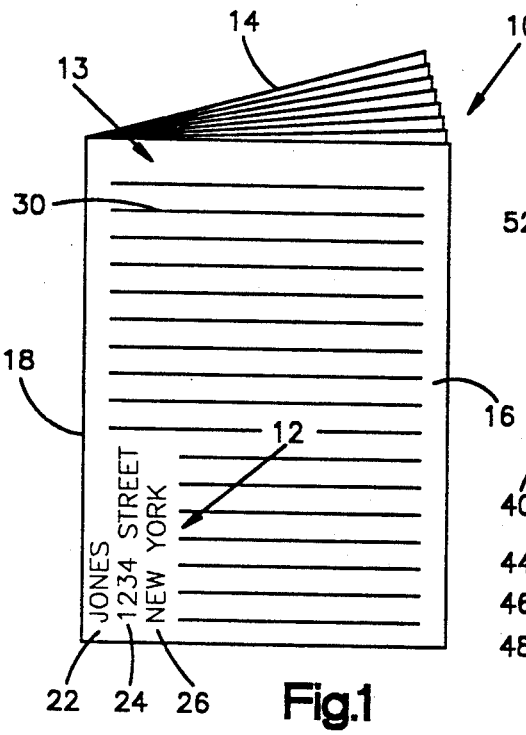
Fig.1 (PRIOR ART)
FIG. 1 is an illustration of a known signature having personalized information printed on the signature with lines of characters extending parallel to a fold in the signature.

A group 10 of sheet material having personalized or other selected information 12 printed on an outer sheet material item or signature 13 in a known manner is illustrated in FIG. 1. The signature 13 includes a pair of opposite major sides 14 and 16 which are separated by a fold 18. The personalized information 12 includes a plurality of lines 22, 24, and 26 of characters. Lines 22, 24, and 26 of characters extend parallel to the fold 18. However, preprinted material, indicated schematically at 30, on the signature 13 includes lines of characters which extend perpendicular to the fold 18. Thus, the personalized information 12 and the preprinted material 30 extend transversely relatively to each other rather being oriented in the same direction.

The outer sheet material item or signature 34 (FIG. 2) of a second group 35 of sheet material also has a pair of major sides 36 and 38 which are interconnected at a fold 40. Personalized or other selected information 42 is printed on the major side 38 of the signature 34. The information 42 includes a plurality of lines 44, 46, and 48 of characters.

The lines 44, 46, and 48 of characters on the signature 34 extend perpendicular to the fold 40. Preprinted material, indicated schematically at 52 in FIG. 2, also contains lines of characters which extend perpendicular to the fold 40. Thus, both the preprinted material 52 and the selected information 42 on the major side 38 of the signature 34 extend perpendicular to the fold 40 and have the same orientation relative to the signature. Since the material 52 and selected information 42 are both printed in the same orientation on the major side 38 of the signature 34, both areas of material can be readily read. Although the sheet material item 34 is a signature having a fold, the sheet material item does not have to be a signature.

Although the selected information is printed on only the outer signature 34 of the sheet material 35, information could be printed on other signatures of the sheet material. This information would also be printed in one or more lines of characters extending perpendicular to a fold in the signature.

Figure 2:
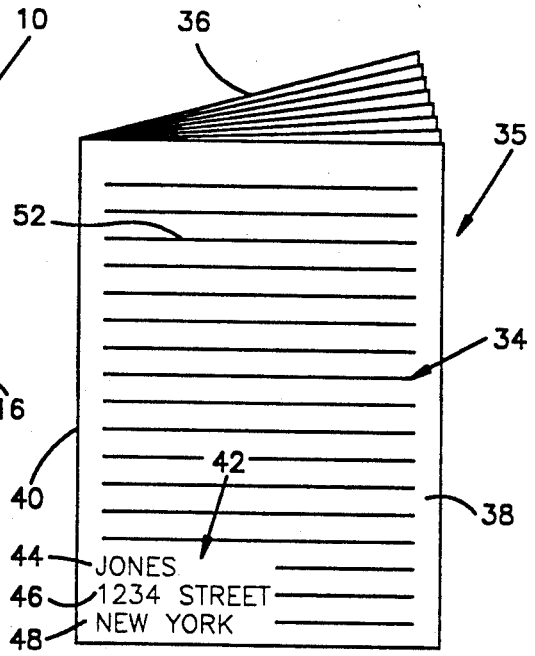
FIG. 2 is an illustration of a signature having personalized information printed on the signature with lines of characters extending perpendicular to a fold in the signature.
Figure 3:
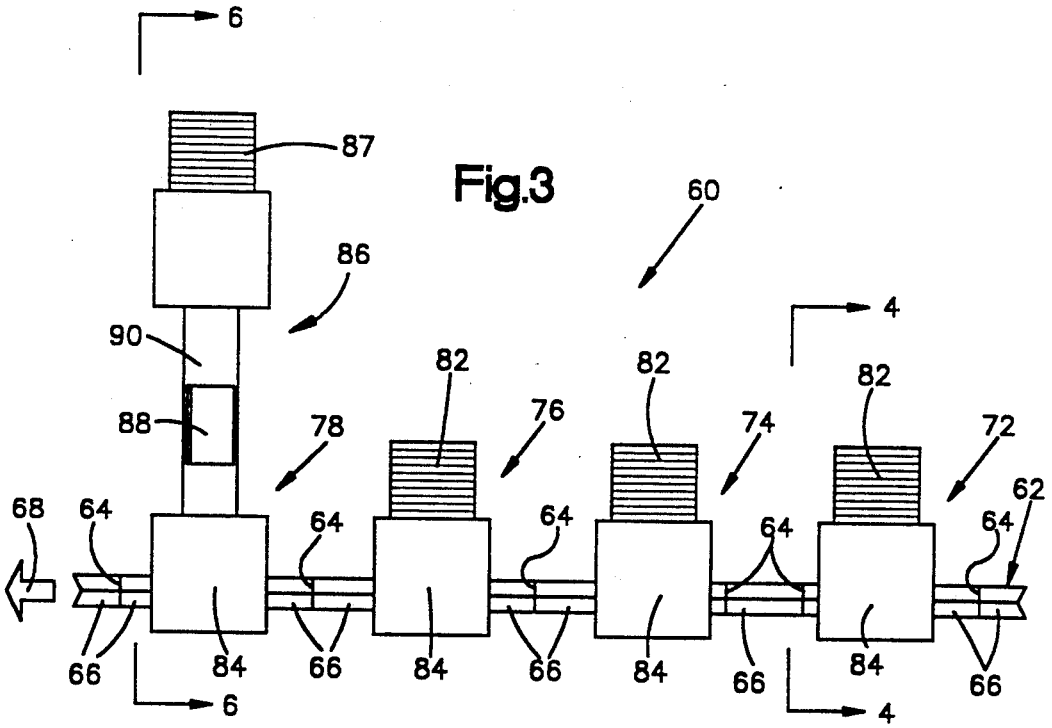
FIG. 3 is a schematic illustration of a collating conveyor and a sheet material feed assembly which is used to feed sheet material with selected information printed thereon to a feed station along the collating conveyor.

A collator apparatus 60 constructed in accordance with the present invention is illustrated schematically in FIG. 3. The collator 60 forms sheet material groups 35 formed of preprinted folded signatures with information printed on at least one signature 34 in the group of sheet material, as illustrated in FIG. 2. Thus, the personalized or other selected information is printed on the signature 34 in lines 44, 46, and 48 of characters which extend perpendicular to a fold 40 in the signature.

The apparatus 60 includes a longitudinally extending main or collating conveyor 62. The collating conveyor 62 is of the well known saddle type. However, other types of collating conveyors, such as a flatback conveyor, could be used. Thus, if the sheet material item 34 was not folded, the collating conveyor 62 would have a flat support surface for receiving the sheet material item. The collating conveyor 62 includes a plurality of pusher fingers or lugs 64 which are connected to a conveyor chain and cooperate with each other to form sheet material receiving locations 66.

The sheet material receiving locations 66 are moved along a linear path in the direction of the arrow 68, by the collating conveyor 62. Sheet material feeder assemblies 72, 74, 76 and 78 are disposed in a linear array at feed stations along the main conveyor 62. The sheet material feed assemblies 72–78 sequentially feed preprinted folded signatures to each of the receiving locations 66 on the collating conveyor 62 at the feed stations to sequentially form sheet material groups 35 of signatures.

As each of the receiving locations 66 moves past each of the sheet material feed assemblies 72–78 in turn, a sheet material group 35 of signatures is formed at the receiving location. A pusher finger 64 engages a trailing edge portion of each of the sheet material groups 35 and moves the sheet material groups in the direction of the arrow 68.

Since the collating conveyor 62 is of the well known saddle type, the sheet material groups 35 of signatures hang downwardly from the collating conveyor 62. The opposite major sides of each of the signatures extends downwardly on opposite sides of the collating conveyor 62. The fold which separates the major sides of each signature is disposed along the center line of the collating conveyor 62. The collating conveyor 62 has opposite side surfaces which slope downwardly and outwardly from a peak portion of a conveyor. These side surfaces engage inner side surfaces on the lowermost signature in a sheet material group 35 of signatures to support the sheet material in a known manner. Although a saddle type collating conveyor 62 has been described and illustrated, a flatback type collating conveyor having a chain for pushing sheet material groups along a flat support surface could be used if desired.

Figure 4:
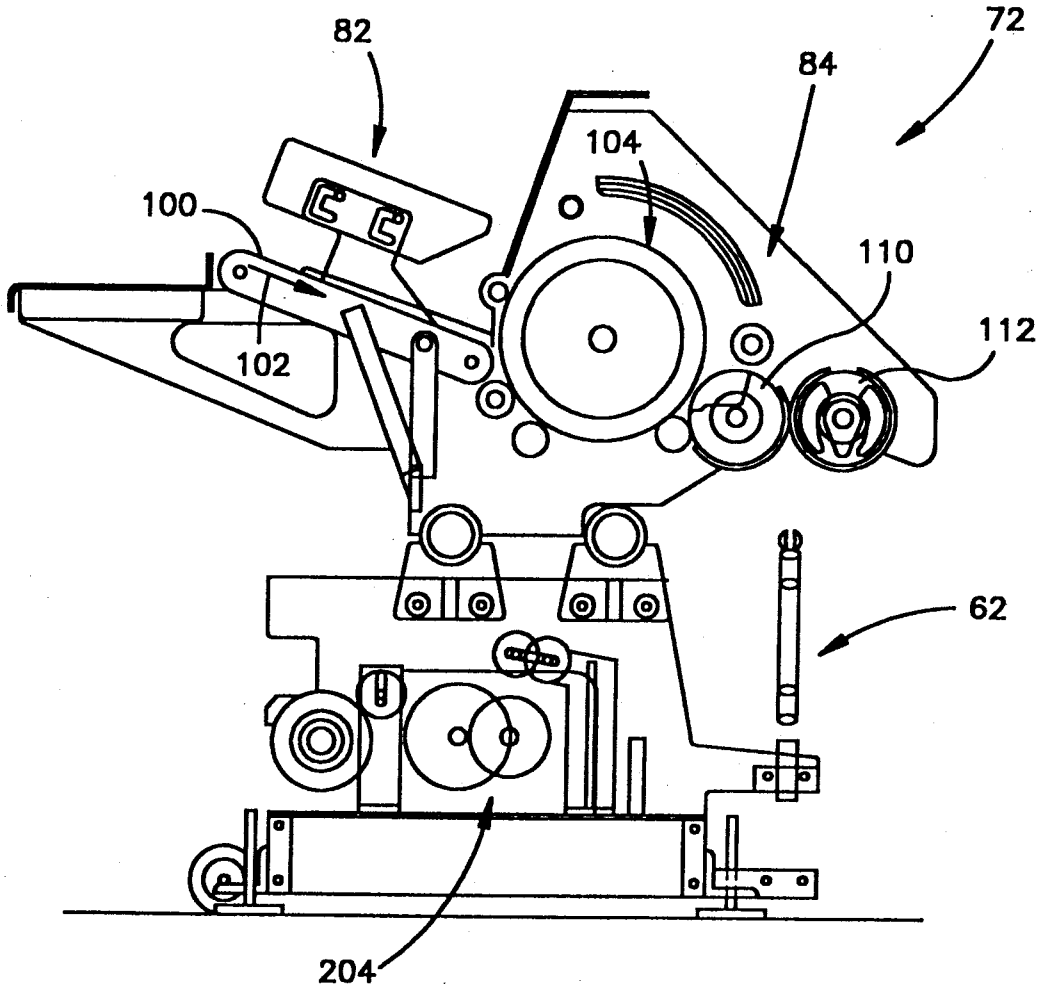
FIG. 4 is a side elevational view, taken generally along the line 4—4 of FIG. 3, illustrating the construction of a typical collating conveyor feed station.

The sheet material feed assemblies 72, 74, and 76 each include a hopper 82 (FIGS. 3 and 4). The hopper 82 of each sheet material feed assembly 72, 74 or 76 holds preprinted and folded signatures which ar different than the signatures held by the hoppers of the adjacent sheet material feed assemblies. A transfer assembly 84 is provided in each of the sheet material feed assemblies 72, 74, and 76 to sequentially feed signatures from a hopper 82 to receiving locations 66 on the collating conveyor 62 as the receiving locations sequentially move past the transfer assemblies 84. The sheet material feed assemblies 72, 74, and 76 all have the same construction.

The sheet material feed assembly 78 differs from the feed assemblies 72, 74, and 76 in that the feed assembly 78 includes a secondary sheet material feed assembly 86 (FIGS. 3 and 5) which sequentially moves signatures 34 from a secondary hopper 87 to a transfer assembly 84. The secondary hopper 87 has the same construction as the hoppers 82. The transfer assemblies 84 in the feed assemblies 72, 74, 76 and 78 (FIGS. 3, 4 and 6) all have the same construction. Although the sheet material feed assemblies 72, 74, 76 and 78 feed signatures to the collating conveyor 62, the feed assemblies could be constructed and utilized to feed unfolded sheets of material to a different type of collating conveyor if desired.

A printer assembly 88 in the secondary sheet material feed assembly 86 (FIGS. 3 and 5) prints selected information on each of the preprinted and folded signatures 34 as it is moved from the secondary hopper 87 to the transfer assembly 84. The selected information is printed on each of the signatures 34 in lines 44, 46, and 48 of characters which extend perpendicular to the fold 40, in the manner illustrated in FIG. 2. The selected information may be printed on opposite sides of the signatures if desired.

The preprinted and folded signatures 34 (FIG. 2) are moved from the secondary hopper 87 (FIGS. 3, 5 and 6) to a secondary conveyor 90 with the folds 40 leading. The secondary conveyor 90 moves the signatures 34 toward the collating conveyor 62 along a path which extends perpendicular to the longitudinal central axis of the collating conveyor 62 (FIG. 3). The secondary conveyor 90 moves the signatures 34 with the major sides 38 facing upwardly and the with the major sides 36 facing downwardly.

As each signature 34 is moved through the printer assembly 88 by the secondary conveyor 90, selected information is printed on the signature. The selected information is printed in lines 44, 46, and 48 of characters which extend parallel to the path of movement of the signature and perpendicular to the path of movement of the collating conveyor 62. The selected information may be printed either directly on the signature or on a label disposed on the signature.

Figure 6:
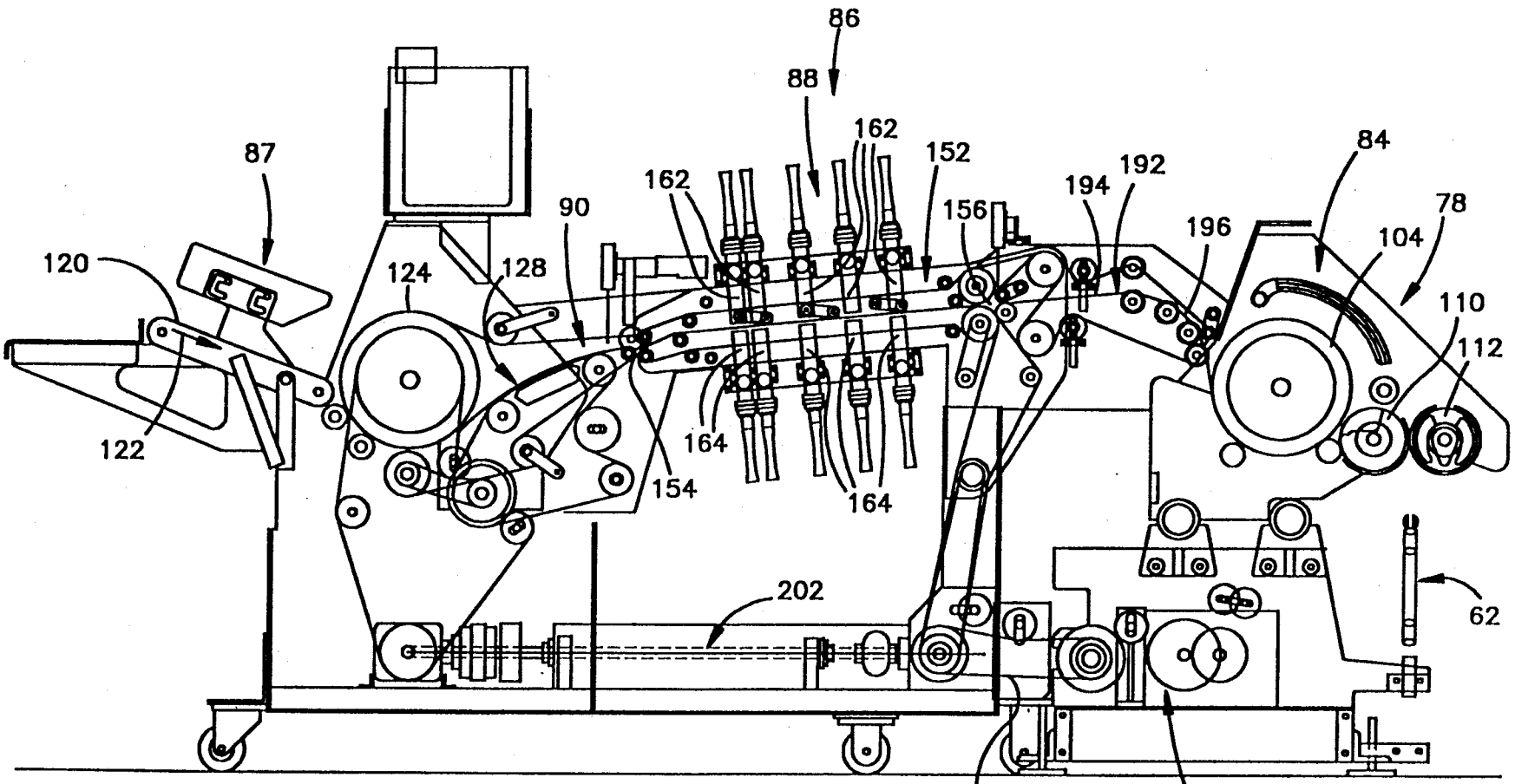
FIG. 6 is a side elevational view, generally similar to FIG. 5, illustrating the relationship of the sheet material feed assembly to a feed station of the collating conveyor.

The signatures 34 with the selected information printed on the major sides 38, are sequentially transferred to the collating conveyor 62 by the transfer assembly 84 (FIGS. 3 and 6). When the signatures 34 are transferred to the collating conveyor 62, the lines 44, 46, and 48 of characters printed by the printer assembly 88 extend perpendicular to the longitudinal central axis of the collating conveyor and the path of movement of the signatures by the collating conveyor.

The sheet material feed assembly 72 at one of the collating conveyor feed stations is illustrated in FIG. 4. The sheet material feed assembly 72 includes the hopper 82 in which sheet material is held on edge with the folded edge downwardly and major side surfaces extending upwardly. Thus, folded edged of the signatures are downwardly against feed chains 100 and the sides of the signatures extend upwardly perpendicular to the upper runs of the feed chains. The upper runs of the feed chains are driven in the direction of the arrows 102 in FIG. 4 to move the signatures along a downwardly sloping path toward a main feed drum 104 in a known manner.

Suitable suckers (not shown) engage each of the signatures in turn adjacent to the main feed drum 104 (FIG. 4) and move the folded lower edge portion of each signature away from the other signatures in the hopper 82. This positions the folded leading edge portion of the signature tangentially to the main feed drum 104 at a pickup location where the signature is engaged by grippers (not shown) on the main feed drum 104. The grippers on the main feed drum 104 grip the lower edge portion of the signature at the pickup location as the main feed drum is rotated in a counterclockwise direction (as viewed in FIG. 4). Rotation of the main feed drum 104 in a counterclockwise direction moves the signature part way around the main feed drum toward the collating conveyor 62.

The main feed drum 84 of the sheet material feed assembly 72 (FIG. 4) then releases the signature. A transfer cylinder 110 engages the open edges of the signatures and carries it to an opener cylinder 112. The signature is opened by cooperation between the transfer and opener cylinders 110 and 112 and is dropped downwardly onto the collating conveyor assembly 62. The transfer assembly 84 may have many different known constructions, such as those illustrated in U.S. Pat. Nos. 2,251,943; 2,855,195; 3,692,300; and 3,809,384.

The signature is placed on the collating conveyor 62 with the fold extending parallel to the path of movement of the collating conveyor. The collating conveyor 62 moves the signature to additional feed stations (FIG. 3) where additional signatures are fed to form the group 35 of sheet material. The group 35 of sheet material is then moved by the collating conveyor 62 to additional stations (not shown) where further operations are performed on the sheet material. For example, the signatures in the group 35 of sheet material may be moved to a stitcher assembly in which the signatures are stapled along the folds.

The sheet material feed assembly 72 (FIG. 4) utilizes the hopper 82 to hold the sheet material adjacent to the main feed drum 104 and the collating conveyor 62. The signatures are fed from the hopper 82 to the collating conveyor 62 without printing personalized or other selected information 42 on the signatures.

Figure 5:
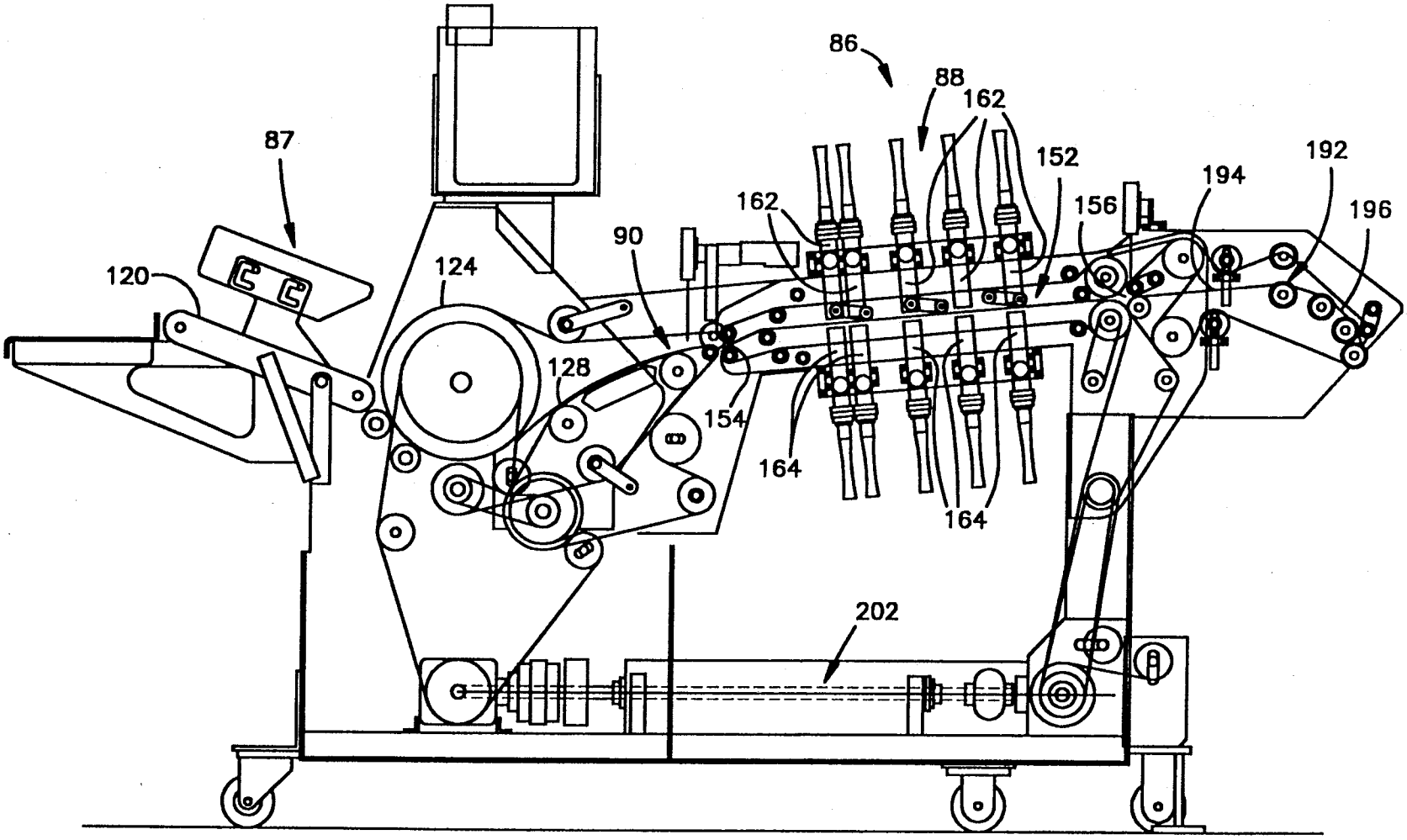
FIG. 5 is a side elevational view of a sheet material feed assembly constructed in accordance with the present invention and used to feed sheet material to a main feed drum at a collating conveyor feed station.

When personalized or other selected information 42 is to be printed on the signatures, the secondary sheet material feed assembly 86 (FIG. 5) is used to supply sheet material to the main feed drum 104 (FIG. 6). Thus, when the secondary sheet material feed assembly 86 of FIG. 5 is to be used at a feed station along the collating conveyor 62, the hopper 82 with the feed chains 100 is removed from the selected feed station. The secondary sheet material feed assembly 86 is then connected with the feed station to supply sheet material to the transfer assembly 84 at the selected feed station. Thus, the sheet material supply hopper 82 is removed from the selected one of the sheet material feed assemblies and the secondary feed sheet material assembly 86 is connected with the feed station from which the sheet material supply hopper 82 has been removed.

Although the secondary sheet material feed assembly 86 could be utilized in connection with any one of the sheet material feed assemblies 72, 74 or 76, the secondary sheet material feed assembly is illustrated in FIGS. 3 and 6 as being used in association with the sheet material feed assembly 78. Thus, a supply hopper corresponding to the supply hopper 82 of FIG. 4, was removed from the sheet material feed assembly 78. The secondary sheet material feed assembly 86 was then connected with the sheet material feed assembly 78 to supply sheet material with personalized or other selected information 42 printed thereon to the main feed drum 104 (FIG. 6).

In accordance with a feature of the present invention, sheet material 34 is supplied to the pickup location adjacent the main rotary feed drum 104 by the secondary sheet material feed assembly 86 (FIG. 6) with the leading end portion of the sheet material in the same orientation in which sheet material is supplied to the pickup location adjacent the main feed drum 104 from the hopper 82 (FIG. 4). Therefore, the transfer assembly 84 operates in the same manner when it is supplied with sheet material from the hopper 82 (FIG. 4) as it does when it is supplied with sheet material from the secondary sheet material feed assembly 86 (FIG. 6). If sheet material was supplied to the transfer assembly 84 by the secondary sheet material feed assembly 86 with the leading end portion of the sheet material in a different orientation than in which sheet material is supplied to the transfer assembly 84 from the hopper 82 (FIG. 4), the transfer assembly 84 would have to function in a different manner when supplied with sheet material from the secondary sheet material feed assembly 86 than it does when supplied with sheet material from the hopper 82.

When the transfer assembly 84 is supplied with sheet material by the secondary sheet material feed assembly 86, the secondary conveyor 90 moves the sheet material downwardly and tangentially to the main feed drum 104 (FIG. 6) at the pickup location. At the pickup location, the leading end portion of the sheet material has the same orientation that the leading end portion of the sheet material supplied from hopper 82 (FIG. 4) had at the pickup location for the main feed drum 104 in the sheet material feed assembly 72. Therefore, the grippers on the main feed drum 104 in the sheet material feed assembly 78 (FIG. 6) and the grippers on the main feed drum 104 in the sheet material feed assembly 72 (FIG. 4) engage sheet material when the leading edge portions of the sheet material are in the same orientation relative to the main feed drums.

As the main feed drum 104 in the sheet material feed assembly 78 (FIG. 6) continues to rotate, the signature 34 is moved out of engagement with the secondary sheet material feed assembly 86. The grippers on the main feed drum 104 then release the signature 34. The transfer cylinder 110 (FIG. 6) engages the open edges of the signature 34 and carries it to the opener cylinder 112. The signature 34 is then opened by cooperation between the transfer and opener cylinders 110 and 112 and is dropped downwardly onto the main conveyor assembly 62 in the same manner as previously explained in conjunction with the apparatus of FIG. 4.

The hopper 87 (FIGS. 5 and 6) in the secondary sheet material feed assembly 86 holds signatures 34 with the folded edges of the signatures downwardly against a feed chain 120. The major sides 36 and 38 of the signatures 34 extend upwardly from the feed chain 120. The feed chain 120 is driven to move the signature on a downwardly sloping path toward a secondary or remote feed drum 124 in the same manner as in which the feed chain 100 (FIG. 4) moves signatures downwardly toward the main feed drum 104. The secondary feed drum 124 (FIG. 6) has the same construction as the main feed drum 104 and rotates about a horizontal axis which extends parallel to the horizontal axis about which the main feed drum 104 rotates. The axes of rotation of the secondary feed drum 124 and the main feed drum 104 are disposed in a common horizontal plane.

As the signatures are moved downwardly, in the direction of the arrow 122 (FIG. 6), by the feed chain 120 in the secondary hopper 87, a suitable sucker (not shown) engages the lower end portion of the signature closest to the secondary feed drum 124. The sucker pulls the lower or leading end portion of the signature toward the secondary feed drum 124. When the lower or leading end portion of the signature moves downwardly into a tangential relationship with the secondary feed drum 124 at the pickup location, grippers on the secondary feed drum grip the lower end portion of the signature 34. At this time the lower end portion of the signature 34 is in the same orientation as in which signatures are fed to the main feed drum 104 from the hopper 82 of the sheet material feed assembly 72 of FIG. 4 and is in the same orientation as in which the leading end portion of the signature is moved to the main feed drum 104 by the secondary conveyor 90 in the sheet material feed assembly 78 (FIG. 6). Thus, when the sheet material is fed from the hopper 87 to the secondary feed drum 124, the leading end portion of the sheet material has the same orientation as does the leading end portion of sheet material fed to the main feed drum 104 by the secondary conveyor 90 or from the hopper 82 (FIG. 4). This enables the secondary feed drum 124 to have the same construction and to operate in the same manner as the main feed drums 104.

The secondary feed drum 124 (FIG. 6) feeds the sheet material to the secondary conveyor 90. An initial run or segment 128 of the secondary conveyor 90 slopes upwardly away from the secondary feed drum 124 at an acute angle to a horizontal plane. As the sheet material moves along the initial segment or run 128 of the secondary conveyor 90, the folded leading end portion of the signatures 34 are aligned with the printer assembly 88. Thus, a sheet material registration assembly 132 (FIG. 7) engages a folded leading edge 40 of the signature 34.

The sheet material registration assembly 132 includes registration members 134 having flat trailing side surfaces 136 which extend perpendicular to the path of movement of the sheet material by the secondary conveyor 90. The side surfaces 136 are disposed in precise alignment with the printer assembly 88. Therefore, when the folded leading edge 40 of the signature 34 is disposed in abutting engagement with the side surfaces 136, the signature has the desired alignment with the printer assembly 88.

Figure 7:
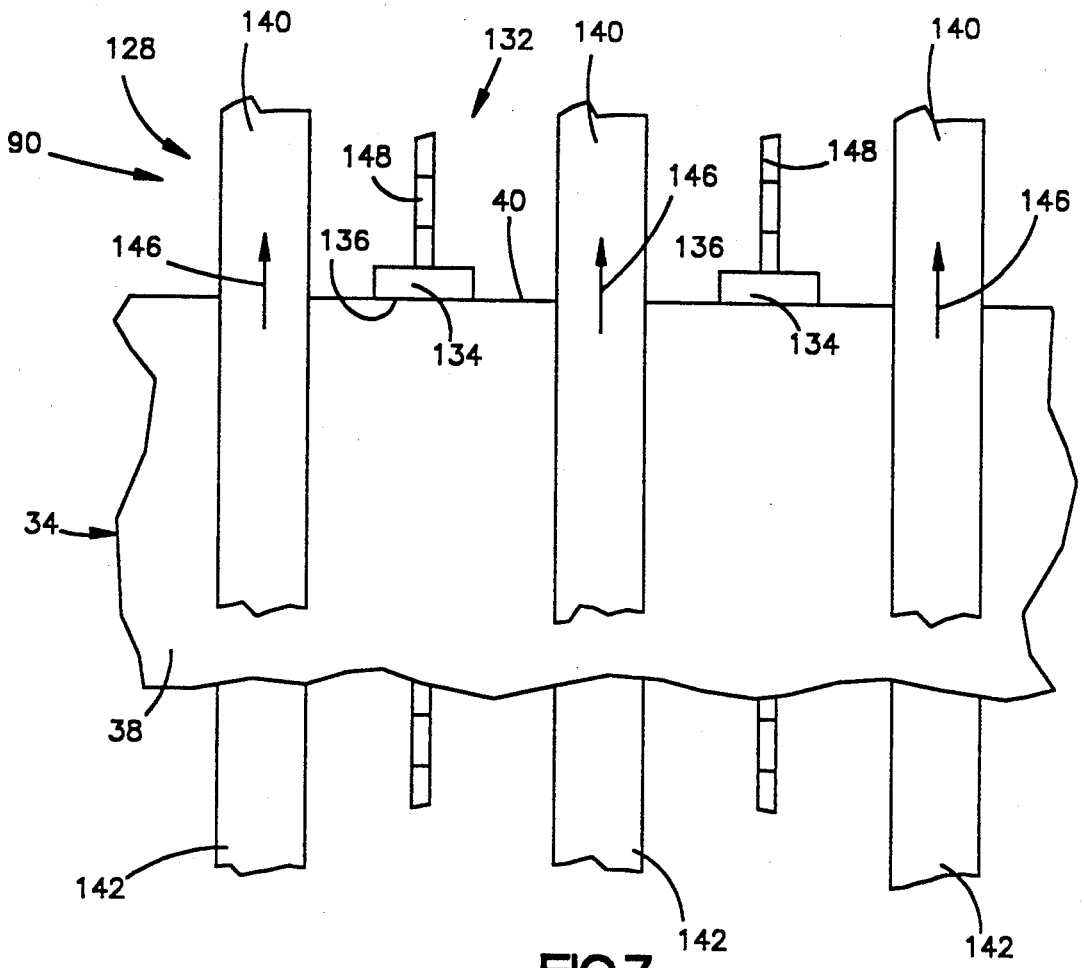
FIG. 7 is a schematicized fragmentary view illustrating a plurality of registration members for aligning sheet material with a printer assembly while the sheet material is being moved by conveyor belts.

The secondary conveyor includes a set of upper belts 140 which engage an upwardly facing major side 38 (FIG. 2) of the outermost signature 34 and a lower set of belts 142 (FIG. 7) which engage a downwardly facing lower side 36 of the outermost signature 34. The signature 34 is gripped between the upper belts 140 and the lower belts 142 and moves forwardly, that is in the direction of the arrows 146 in FIG. 7, toward the printer assembly 88. The registration members 134 are moved forwardly, in the direction of the arrows 146, by chains 148. The chains 148 are driven forwardly at a slightly slower speed than the belts 140 and 142. Therefore, the belts 140 and 142 move the folded leading edge 40 of the signature 34 into abutting engagement with the registration members 134, as shown in FIG. 7.

When the signature 34 moves forwardly with the registration members 134, slippage occurs between the surfaces of the belts 140 and 142 and the lower and upper sides 36 and 38 of the signature. The registration members 134 remain in engagement with the folded leading edge of the signature 34 for a relatively short time and then move downwardly away from the path of movement of the signature. Therefore, the slippage which occurs between the belts 140 and 142 and the lower and upper sides 36 and 38 of the signature 34 is not so great as to cause deformation of the signature.

After the sheet material have been aligned with the printer assembly 88, the sheet material moves from the initial segment 128 of the secondary conveyor 90 to a second or printer segment 152 of the secondary conveyor. The printer segment 152 of the secondary conveyor 90 extends through the printer assembly 88 and moves the signature 34 through the printer assembly. The printer segment 152 extends from an inlet 154 to the printer assembly 88 to a discharge 156 from the printer assembly 88.

The printer segment 152 of the secondary conveyor 90 slopes upwardly at an angle which is skewed relative to a horizontal plane. Although both the initial segment 128 and the printer segment 152 of the secondary conveyor 90 are skewed relative to a horizontal plane, the initial segment is skewed at a greater angle to the horizontal plane than is the printer segment. Thus, in one specific embodiment of the invention, the initial segment 128 of the secondary conveyor 90 was skewed at an angle of approximately 28° to the horizontal while the printer segment 152 was skewed at an angle of approximately 7° relative to the horizontal. It should be understood that the foregoing specific angles at which the initial and printer segments 128 and 152 of the secondary conveyor 90 are skewed relative to the horizontal have been set forth herein only for purposes of clarity of description and it is contemplated that the initial segments and printer segments could be skewed at different angles if desired.

The inlet 154 to the printer segment 152 of the secondary conveyor 90 is above a horizontal plane containing the axes of rotation of the secondary feed drum 124 and main feed drum 104. Thus, by the time the sheet material 34 enters the printer assembly 88, the sheet material will have moved to a level above the axis of rotation of the secondary feed drum 124 and the axis of rotation of the main feed drum 104 (FIG. 6).

The printer assembly 88 is of the ink jet type. Thus, an upper array of ink jet nozzles 162 are provided to direct ink downwardly against the upper side 38 of the signature 34. A lower set of ink jet nozzles 164 are provided to direct ink upwardly against the lower side 36 of the outer signature 34. The upper and lower nozzles 162 and 164 of the ink jet printer assembly 88 are disposed above the horizontal plane containing the axes of rotation of main and secondary feed drums 104 and 124.

Charged droplets of ink from the nozzles 162 and 164 pass between deflection plates and are deflected to form characters. The upper nozzles 162 are utilized to print lines of characters on the upwardly facing major side 38 of the signature 34. The lower nozzles 164 are utilized to print lines of characters on the downwardly facing major side 36 of the signature 34. Of course, if printing is desired on only one side of the signatures, only one set of the nozzles 162 or 164 would be utilized.

The nozzles 162 and 164 direct streams of ink in directions which are perpendicular to the major sides 36 and 38 of the signature 34. Thus, the streams of ink from the nozzles 162 and 164 are skewed at acute angles relative to a vertical plane and are perpendicular to the printer segment 152 of the secondary conveyor 90. In the embodiment of the invention in which the printer segment 152 of the secondary conveyor 90 slopes upwardly at an angle of approximately 7° to a horizontal plane, the streams of ink from the nozzles 162 and 164 would be skewed at an angle of approximately 7° to the vertical.

By skewing the direction of flow of ink from the nozzles 162 and 164 to the vertical, clogging of the nozzles due to movement of ink back into the nozzles tends to be avoided. Thus, if the nozzles 164 directed ink vertically upwardly toward the sheet material, random droplets from the spray would tend to fall back downwardly onto the nozzles and clog the nozzles. By having the nozzles 164 direct the flow of ink upwardly along paths which are skewed at an acute angle to the vertical, random drops of ink tend to fall downwardly at a location offset to one side, that is to the left as viewed in FIG. 6, of the nozzles 164.

It is contemplated that during use of the secondary sheet material feed assembly 86, it will be desired to print at various locations on the major sides 36 and 38 of the signature 34. To enable the nozzles 162 and 164 to direct streams of ink against different locations on the major sides 36 and 38 of the signature 34, the belts 140 and 142 are movable transversely to the direction of movement of the sheet material through the printer assembly 88. This allows the belts 140 and 142 to be moved to positions in which they engage the sheet material at locations where it is not desired to print on the sheet material with the printer assembly 88.

The upper belts 140 can be moved independently of the lower belts 142. Therefore, the upper and lower nozzles 162 and 164 can print at locations which are offset relative to each other on the major sides 36 and 38 of the signature 34. The upper belts 140 (FIGS. 8 and 10) extend around drive pulleys 172 and 174 which are slidably mounted on a externally splined drive shaft 176. Collars 178 and 180 abut opposite sides of the pulley 172 and are secured to the shaft 176 to hold the pulley against axial movement relative to the shaft. Similarly, collars 182 and 184 are secured to the shaft 176 to hold the pulley 174 against axial movement relative to the shaft.

When the positions of the belts 140 are to be adjusted relative to the shaft, the collars 178, 180, 182, and 184 are loosened and the pulleys and collars are moved axially along the shaft. This results in the belts 140 being moved transversely relative to each other. When the belts 140 have been moved transversely to positions in which they do not block the printing at desired locations on the signature 34, the collars 178, 180, 182 and 184 are again secured to the shaft 176 to hold the pulleys 172 and 174 in place. Although only the pulleys 172 and 174 for one end of the belts 140 have been shown in FIG. 8, it should be understood that similar pulleys are held in position by similar collars at the opposite ends of the belts. Thus, both ends of the belt are adjusted at the same time so that the longitudinal axes of the belts 140 remain parallel to the path of movement of the sheet material through the printer assembly 88.

Figure 8:
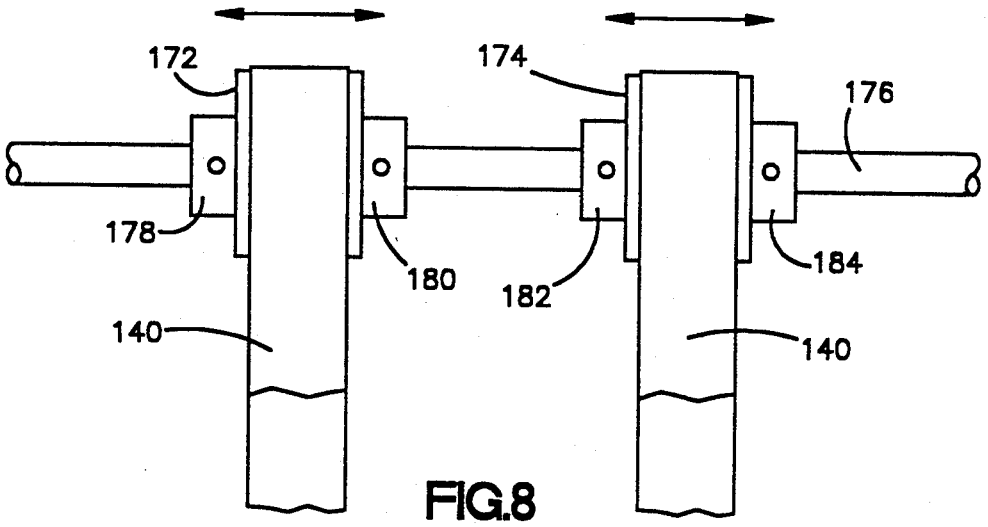
FIG. 8 is a fragmentary schematic illustration depicting the manner in which the conveyor belts are movable transversely to the path of movement of the sheet material to enable a printer assembly to print at a desired location on the sheet material.

Although only the belts 140 have been shown in FIG. 8, it should be understood that the lower belts 142 are also adjustable in the same manner as the belts 140. Thus, all the belts for the printer segment or run 152 of the secondary conveyor 90 can be adjusted transversely to the path of movement of the sheet material through the printer assemblies 88. The pulleys for the lower belts 142 are connected with externally splined drive and idler shafts by the collars in the same manner as in which the pulleys 172 and 174 for the upper belts 140 are connected with the splined shaft 176. The positions of the lower belts 142 can be adjusted independently of the positions of the upper belts 140.

Figure 10:
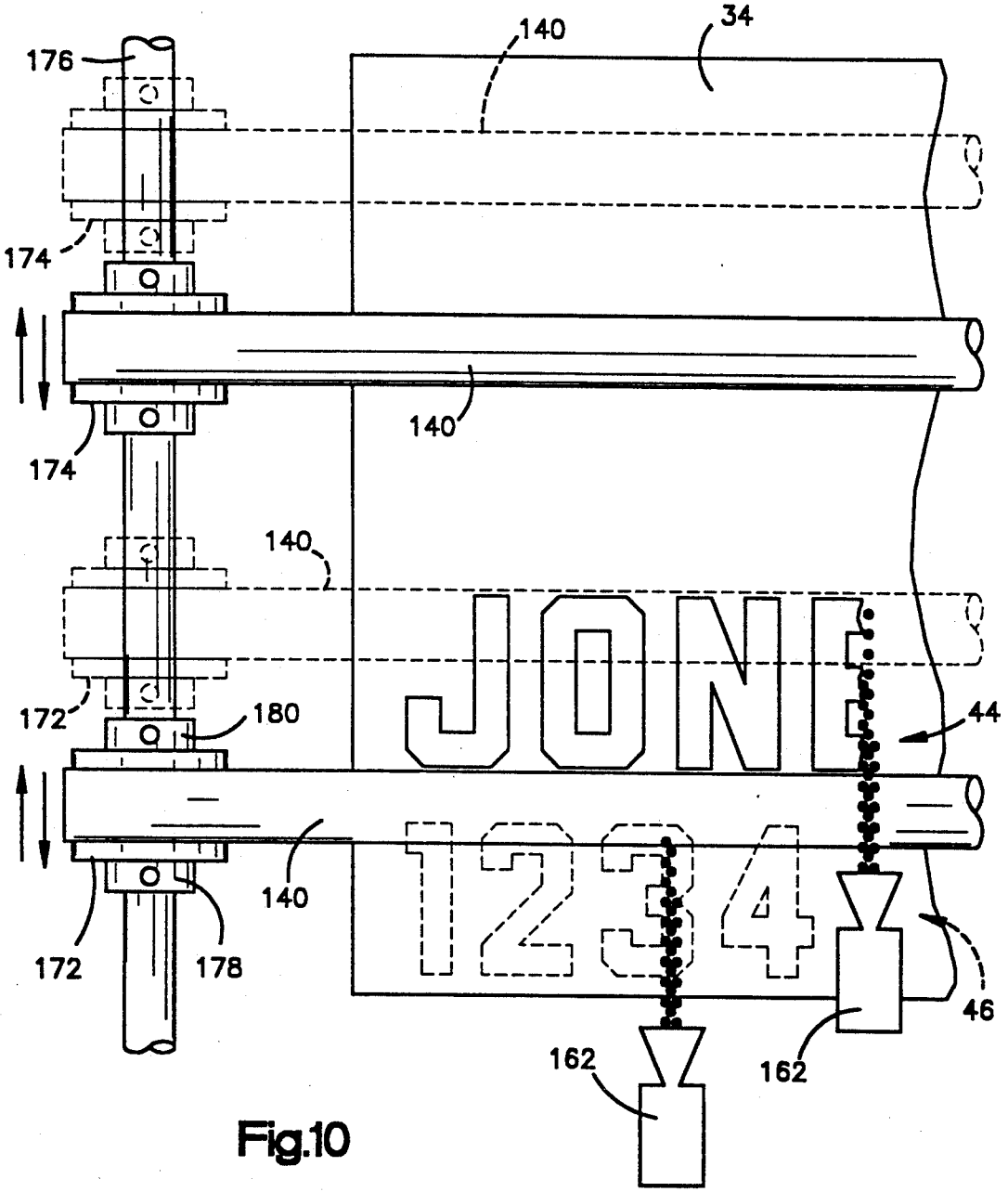
FIG. 10 is a schematic illustration depicting the manner in which conveyor belts are movable transversely to the path of movement of the sheet material to enable the printer assembly to print at two different locations on the sheet material.

When the signatures 34 are to be printed on at the location indicated by the numeral 44 in FIG. 10, the belts 140 may be positioned as shown in solid lines in FIG. 10. When the signatures 34 are to printed on at the locations indicated at 46 in FIG. 10, the belts 140 may be positioned at the locations shown in dashed lines in FIG. 10. Of course, if the signatures 34 were to be printed on at both the locations 44 and 46, the left (as viewed in FIG. 10) belt 140 would be moved closer to the right belt so that the locations indicated at 44 and 46 would both be free of obstructions.

When the signature 34 moves from the initial segment 128 (FIG. 6) of the secondary conveyor 90 to the printer segment 152 of the secondary conveyor, the sheet material is at a location above a horizontal plane containing the axes of rotation of the main feed drum 104 and secondary feed drum 124. Thus, the entrance 154 to the printer segment 152 of the secondary conveyor 90 is above the horizontal plane containing the parallel axes of rotation of the main and secondary drums 104 and 124. Since the printer segment 152 of the main conveyor 90 slopes upwardly at an acute angle to the horizontal plane, the discharge 156 from the printer segment is also above the horizontal plane containing the axes of rotation of the main and secondary feed drums 104 and 124. Therefore, the printing on the group 35 of sheet material occurs in the printer assembly 88 at locations above the horizontal plane containing the axes of rotation of the main and secondary feed drums 104 and 124.

Due to the upwardly sloping orientation of the printer segment 152 of the secondary conveyor 90, the discharge 156 from the secondary conveyor is disposed above a horizontal plane extending tangentially to the uppermost sides of the main feed drum 104 and secondary feed drum 124. Therefore, when the signature 34 exits from the printer assembly 88, the signature is above the main and secondary feed drums 104 and 124. Although the initial segment 128 and printer segment 152 of the secondary conveyor 90 has been shown in FIG. 6 as sloping upwardly at different acute angles relative to a horizontal plane, the initial segment and printer segment of the secondary conveyor could slope upwardly at the same acute angle relative to a horizontal plane if desired. However, it is preferred to register the leading end portion of the sheet material in the initial segment 128 which slopes upwardly at a relatively large angle to a horizontal plane and to print on the sheet material in the printer segment 152 which slopes upwardly at a relatively small angle relative to a horizontal plane.

A discharge segment 192 (FIG. 6) of the secondary conveyor 90 receives the sheet material from the printer segment 152 of the main conveyor. An inlet portion 194 of the discharge segment 192 slopes upwardly at the same angle relative to a horizontal plane as does the printer segment 152 of the secondary conveyor 90. An outlet portion 196 of the discharge segment 192 slopes downwardly at an acute angle toward the main feed drum 104.

The relatively steeply sloped outlet portion 196 of the discharge segment 192 of the secondary conveyor 90 positions the folded leading end portion 40 of a signature 34 in the same orientation relative to the main feed drum 104 as the leading end portion of the signature would be positioned in if it had been fed from the hopper 82 (FIG. 4). Thus, the outlet portion 196 (FIG. 6) of the discharge segment 192 positions the leading end portion of the signature 34 relative to the feed drum 104 in the same orientation as in which the leading end portion of the signature is positioned relative to the secondary feed drum 124 as it is fed from the hopper 87. This enables the main feed drum 104 to grip the leading end portion of a signature 34 in the same manner as in which it would grip the signature if it had been fed directly from the hopper 82 of FIG. 4 rather than from the remote secondary hopper 87.

Since the signature 34 is gripped by the main feed drum 104 in the same manner as in which it would have been had it been fed from the hopper 82, the transfer assembly 84 operates in the same manner as it would if the material has been fed from the hopper 82 rather than from the remote secondary hopper 87. This enables the secondary sheet material feed assembly 86 to be connected with any one of the feed stations 72, 74, 76 or 78 of the collating conveyor 62 without modifying the transfer assembly 84 at the feed station. Therefore, the secondary sheet material feed assembly 86 can be utilized to print personalized or other selected information 42 on any one of the signatures fed to the collating conveyor 62 at any one of the feed stations along the collating conveyor.

To enable the secondary sheet material feed assembly 86 to operate in timed relationship with the collating conveyor 82, the secondary sheet material feed assembly 86 is driven directly from the drive for the collating conveyor 62. Thus, a drive train 202 (FIG. 6) for the secondary sheet material feed assembly 86 is connected with the drive train 204 for the collating conveyor 62 by a chain 206. This results in the secondary sheet material feed assembly 86 being driven in timed relationship with the collating conveyor 62 regardless of where the secondary sheet material feed assembly 86 is used along the collating conveyor 62.

In the embodiment of the invention illustrated in FIGS. 1–8, sheet material signatures 34 are transferred to a saddle-type collating conveyor 62 by a transfer assembly 84 having a main feed drum 104. However, it is contemplated that the present invention could be utilized in association with a flatback collating conveyor. When the apparatus is used with a flatback collating conveyor, different sheet material feed apparatus may be substituted for the main feed drum 104.

Figure 9:
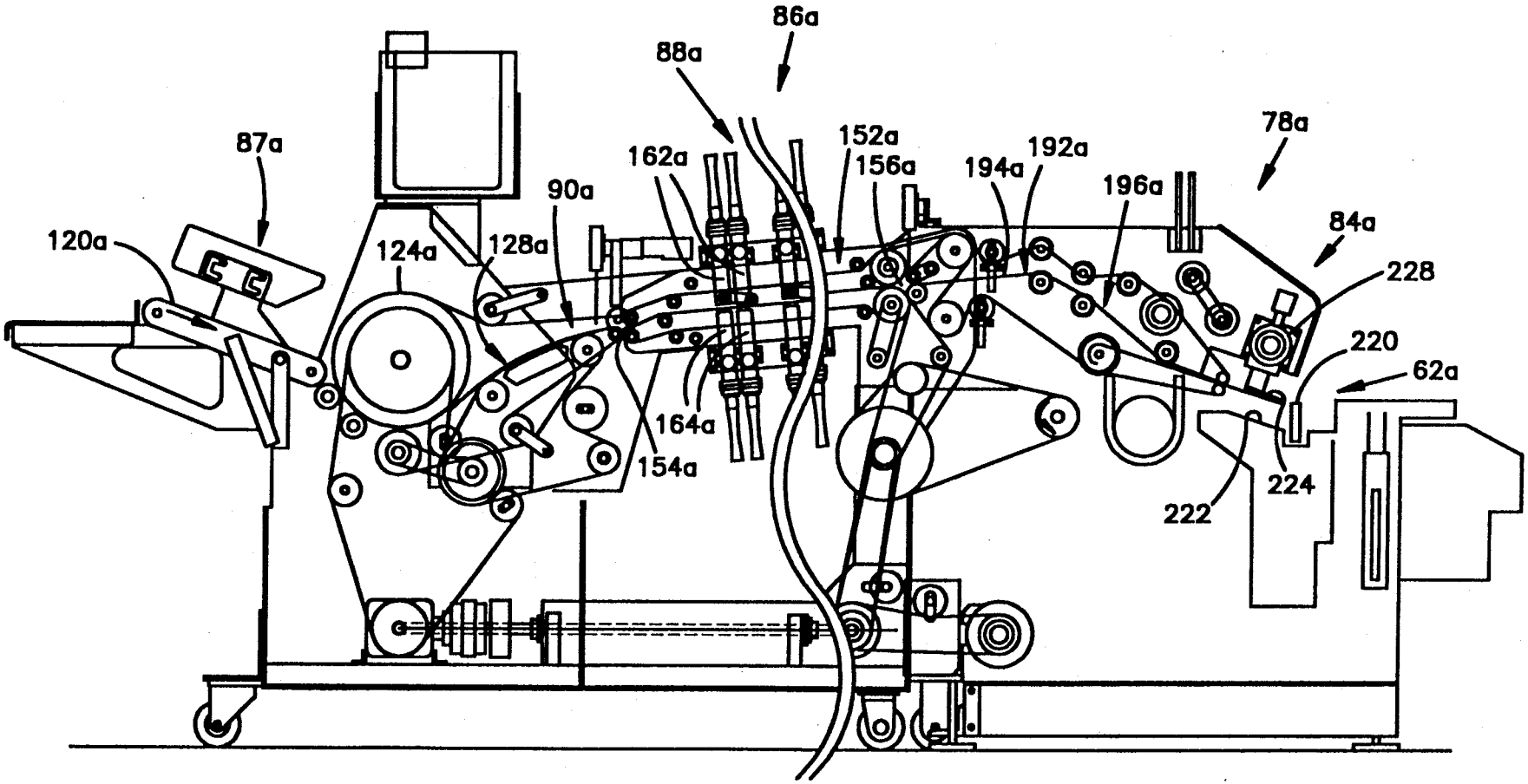
FIG. 9 is a side elevational view generally similar to FIG. 6, illustrating an embodiment of the invention in which the sheet material is accelerated in the direction of movement of the collating conveyor before being deposited on the collating.

In the embodiment of the invention illustrated in FIG. 9, the main or collating conveyor is of the flatback type and the sheet material feed assembly does not include a main feed drum. Since the embodiment of the invention illustrated in FIG. 9 is generally similar to the embodiment of the invention illustrated in FIGS. 1–8, similar numerals will be utilized to designate similar components, the suffix letter "a" being associated with the numerals of FIG. 9 to avoid confusion.

The sheet material feed assembly **78*a* (FIG. 9) differs from the sheet material feed assembly 78 of FIG. 6 in that a transfer assembly 84*a* is operable to move the sheet material away from a pickup location to move the sheet material and in the direction of movement of sheet material by the collating conveyor 62*a*. Once the sheet material has been accelerated to the same speed as the collating conveyor 62*a*, the sheet material is released by the transfer assembly 84*a*** at the collating conveyor.

The sheet material feed assembly 78a includes a secondary sheet material feed assembly 86a which sequentially moves signatures 34 from a secondary hopper 87a to the transfer assembly 84a. A printer assembly 88a (FIG. 9) in the secondary sheet material feed assembly 86a prints selected information on each of the preprinted and folded signatures 34 as it is moved from the secondary hopper 87a to the transfer assembly 84a. The selected information is printed on each of the signatures 34 in lines 44, 46, and 48 of characters which extend perpendicular to the fold 40, in the manner illustrated in FIG. 2. The selected information may be printed on opposite sides of the signatures if desired.

The preprinted and folded signatures 34 (FIG. 2) are moved from the secondary hopper 87a to a secondary conveyor 90a with the folds 40 leading. The secondary conveyor 90a moves the signatures 34 toward the collating conveyor 62a along a path which extends perpendicular to the longitudinal central axis of the collating conveyor 62a (FIG. 3). The secondary conveyor 90a moves the signatures 34 with the major sides 38 facing upwardly and the with the major sides 36 facing downwardly.

As each signature 34 is moved through the printer assembly 88a by the secondary conveyor 90a, selected information is printed on the signature. The selected information is printed in lines 44, 46, and 48 of characters which extend parallel to the path of movement of the signature and perpendicular to the path of movement of the collating conveyor 62a. The selected information may be printed either directly on the signature or on a label disposed on the signature.

The signatures 34 with the selected information printed on the major sides 38, are sequentially transferred to the collating conveyor 62a by the transfer assembly 84a. When the signatures 34 are transferred to the collating conveyor 62a, the lines 44, 46, and 48 of characters printed by the printer assembly 88a extend perpendicular to the longitudinal central axis of the collating conveyor and the path of movement of the signatures by the collating conveyor.

The hopper 87a in the secondary sheet material feed assembly 86a holds signatures 34 with the folded edges of the signatures downwardly against a feed chain 120a. The major sides 36 and 38 of the signatures 34 extend upwardly from the feed chain 120a. The secondary feed drum 124a (FIG. 6) has the same construction as the main feed drum 124 of FIGS. 5 and 6 and rotates about a horizontal axis.

The secondary feed drum 124a (FIG. 6) feeds the sheet material to the secondary conveyor 90a. An initial run or segment 128a of the secondary conveyor 90a slopes upwardly away from the secondary feed drum 124a at an acute angle to a horizontal plane. As the sheet material moves along the initial segment or run 128a of the secondary conveyor 90a, the folded leading end portion of the signatures 34 are aligned with the printer assembly 88a. Thus, a sheet material registration assembly engages a folded leading edge 40 of the signature 34 in the same manner as previously explained in regard to the embodiment of the invention illustrated in FIGS. 1–8.

After the sheet material has been aligned with the printer assembly 88a, the sheet material moves from the initial segment 128a of the secondary conveyor 90a to a second or printer segment 152a of the secondary conveyor. The printer segment 152a of the secondary conveyor 90a extends through the printer assembly 88a and moves the signature 34 through the printer assembly. The printer segment 152a extends from an inlet 154a to the printer assembly 88a to a discharge 156a from the printer assembly 88a.

The printer segment 152a of the secondary conveyor 90a slopes upwardly at an angle which is skewed relative to a horizontal plane. Although both the initial segment 128a and the printer segment 152a of the secondary conveyor 90a are skewed relative to a horizontal plane, the initial segment is skewed at a greater angle to the horizontal plane than is the printer segment. Thus, in one specific embodiment of the invention, the initial segment 128a of the secondary conveyor 90a was skewed at an angle of approximately 28° to the horizontal while the printer segment 152a was skewed at an angle of approximately 7° relative to the horizontal. It should be understood that the foregoing specific angles at which the initial and printer segments 128a and 152a of the secondary conveyor 90 are skewed relative to the horizontal have been set forth herein only for purposes of clarity of description and it is contemplated that the initial segments and printer segments could be skewed at different angles if desired.

The inlet 154a to the printer segment 152a of the secondary conveyor 90 is above a horizontal plane containing the axis of rotation of the secondary feed drum 124a. Thus, by the time the sheet material 34 enters the printer assembly 88a, the sheet material will have moved to a level above the axis of rotation of the secondary feed drum 124a.

The printer assembly 88a is of the ink jet type. Thus, an upper array of ink jet nozzles 162a are provided to direct ink downwardly against the upper side 38 of the signature 34. A lower set of ink jet nozzles 164a are provided to direct ink upwardly against the lower side 36 of the outer signature 34. The upper and lower nozzles 162a and 164a of the ink jet printer assembly 88a are disposed above the horizontal plane containing the axis of rotation of secondary feed drum 124a.

Charged droplets of ink from the nozzles 162a and 164a pass between deflection plates and are deflected to form characters. The upper nozzles 162a are utilized to print lines of characters on the upwardly facing major side 38 of the signature 34. The lower nozzles 164a are utilized to print lines of characters on the downwardly facing major side 36 of the signature 34. Of course, if printing is desired on only one side of the signatures, only one set of the nozzles 162a or 164a would be utilized.

The nozzles 162a and 164a direct streams of ink in directions which are perpendicular to the major sides 36 and 38 of the signature 34. Thus, the streams of ink from the nozzles 162a and 164a are skewed at acute angles relative to a vertical plane and are perpendicular to the printer segment 152a of the secondary conveyor 90a. In the embodiment of the invention in which the printer segment 152a of the secondary conveyor 90 slopes upwardly at an angle of approximately 7° to a horizontal plane, the streams of ink from the nozzles 162a and 164a would be skewed at an angle of approximately 7° to the vertical.

It is contemplated that during use of the secondary sheet material feed assembly 86a, it will be desired to print at various locations on the major sides 36 and 38 of the signature 34. To enable the nozzles 162a and 164a to direct streams of ink against different locations on the major sides 36 and 38 of the signature 34, upper and lower belts are movable transversely to the direction of movement of the sheet material through the printer assembly 88a in the manner previously explained in regard to the embodiment of the invention illustrated in FIGS. 1-8. This allows the belts to be moved to positions in which they engage the sheet material at locations where it is not desired to print on the sheet material with the printer assembly 88a.

A discharge segment 192a (FIG. 9) of the secondary conveyor 90a receives the sheet material from the printer segment 152a of the main conveyor. An inlet portion 194a of the discharge segment 192a slopes upwardly at the same angle relative to a horizontal plane as does the printer segment 152a of the secondary conveyor 90a. An outlet portion 196a of the discharge segment 192a slopes downwardly at an acute angle toward the transfer assembly 84a.

The transfer assembly 84a (FIG. 9) engages the sheet material at a pickup location disposed at the right (as viewed in FIG. 9) end of the outlet portion 196a. The transfer assembly 84a moves the engaged sheet material away from the pickup station at the end of the outlet portion 196a toward the collating conveyor 62a. In addition, the transfer assembly 84a accelerates the engaged sheet material in the direction in which the collating conveyor 62a moves the sheet material. Therefore, when the transfer assembly 84a releases the sheet material onto the collating conveyor 62a, the sheet material is moving in the direction of movement of sheet material by the collating conveyor and at the same speed as in which the sheet material is being moved by the collating conveyor. This enables the transfer assembly 84a to deposit sheet material on the collating conveyor with the sheet material moving at the same speed and in the same direction as in which it is moved by the collating conveyor. Therefore, there is a minimum of impact force by the collating conveyor 62a against the sheet material which is deposited on the collating conveyor by the transfer assembly 84a.

The collating conveyor 62a is of the flatback type and includes pusher finger 220 which pushes the sheet material along a support surface 222. The transfer assembly 84a includes a rotatable sucker or vacuum head 224 which grips a major side surface of the sheet material at the pickup station adjacent to the end of the outlet portion 196a. A drive assembly 228 rotates the sucker or vacuum head 224 about an axis which is skewed at an acute angle to the vertical and extends perpendicular to the axis of rotation of the secondary feed drum 124a.

The drive assembly 228 includes a drive shaft with bevel gearing. The bevel gearing drives a planetary gear arrangement which is connected to the sucker or vacuum head 224. A suction hose (not shown) conducts vacuum or suction to the sucker or vacuum head 224. The general construction of the drive assembly 228 and vacuum or sucker head 224 is the same as is described in U.S. Pat. No. 3,311,368 issued Mar. 28, 1967 to Sarring et al. Therefore, the construction of the drive assembly 228 will not be further described herein.

In view of the foregoing description, it is apparent that the present invention provides a sheet material feed assembly 86 which is used to feed sheet material to a main feed drum 104 at a feed station 72, 74, 76 or 78 of a collating conveyor 62. The collating conveyor 62 may be of either the saddle type (FIGS. 4 and 6) or flatback type 62a (FIG. 9). The sheet material feed assembly 86 is driven by the drive system 204 for the collating conveyor.

The sheet material feed assembly 86 (FIG. 5) includes a remote or secondary feed drum 124 which feeds sheet material from a holder 87 to a secondary conveyor 90. The secondary conveyor 90 transports the sheet material through a printer assembly 88 to a sheet material feed assembly 84 or 84a (FIGS. 6 and 9) a station of the collating conveyor 62 or 62a. The secondary conveyor 62 moves the sheet material to the sheet material feed assembly 84 or 84a with the leading edge portion of the sheet material in the same orientation that the leading edge portion of the sheet material would be in if the sheet material had been fed from a holder 82 (FIG. 4) disposed immediately adjacent to sheet material feed assembly. In the embodiment of FIG. 6, the sheet material feed assembly 84 includes a main feed drum 104 can be used to feed sheet material from either directly from a holder 82 (FIG. 4) or from the secondary conveyor 90 of the sheet material feed assembly 86. In the embodiment of FIG. 9, the sheet material feed assembly 84a includes an apparatus 224 and 228 which moves the sheet material in the same direction as the collating conveyor 62a.

When sheet material is being moved by the secondary conveyor 90 or 90a toward the printer assembly 88 or 88a, the leading edge portion of the sheet material is engaged by registration members 134 (FIG. 7) which align the sheet material with the printer assembly. During movement of the sheet material through the printer assembly, the sheet material moves along an upwardly sloping conveyor segment 152a or 152a. Therefore, ink jet nozzles 162 or 162a and 164 or 164a in the printer assembly 88 or 88a direct a flow of ink against the sheet material along a path which is skewed relative to the vertical. This prevents clogging of the ink jet nozzles 162 or 162a and 164 or 164a due to ink falling back onto the nozzles.

The secondary conveyor has belts 140 and 142 which are movable transversely to the path of movement of the sheet material through the printer assembly 88. This enables the printer assembly 88 to be used to print on the sheet material at an desired location. To enable the secondary conveyor 90 to feed the sheet material to the main feed drum 104 in the same orientation as in which the sheet material is fed from a holder 82, the secondary conveyor 90 feeds the sheet material to the main feed drum 104 along a conveyor segment 196 which slopes downwardly toward the main feed drum.

Having described the invention, the following is claimed:

1. An apparatus for feeding sheet material to a first sheet material feed means at a pickup location and from which the sheet material is fed to a longitudinally extending collating conveyor, said apparatus comprising sheet material holder means for holding sheet material, second sheet material feed means for engaging a leading end portion of sheet material which is at least partially held by said holder means and for feeding the sheet material from said holder means, conveyor means for receiving sheet material from said second sheet material feed means and for moving the sheet material to the pickup location to enable the first sheet material feed means to engage the leading end portion of the sheet material at the pickup location, and printer means for printing on the sheet material while the sheet material is being moved by said conveyor means along a path segment which slopes upwardly at an acute angle to a horizontal plane during movement of the sheet material from said second sheet material feed means to the first sheet material feed means, said printer means including a plurality of ink jet nozzles for directing ink toward the sheet material along flow paths which extend at an acute angle to a vertical plane and which extend perpendicular to the upwardly sloping path segment along which the sheet material is moved through said printer means by said conveyor means.

2. An apparatus as set forth in claim 1 wherein said second sheet material feed means engages the leading edge portion of the sheet material while the leading edge portion of the sheet material is in a first orientation, said conveyor means being operable to convey the sheet material to the pickup location with the leading end portion of the sheet material in the first orientation.

3. An apparatus as set forth in claim 1 wherein said conveyor means includes a plurality of belts which grip opposite sides of the sheet material and are spaced apart in a direction transverse to the upwardly sloping path segment along which the sheet material is moved through said printer means by said conveyor means to enable said ink jet nozzles to direct ink into engagement with the sheet material at locations between said belts, said belts being movable transversely to the upwardly sloping path segment along which the sheet material is moved through said printer means by said conveyor means to enable the ink to be directed into engagement with selected locations on the sheet material.

4. An apparatus as set forth in claim 1 wherein said second sheet material feed means includes a feed drum which is rotatable about a horizontal axis and the upwardly sloping path segment along which the sheet material is moved through said printer means is disposed above a horizontal plane containing the axis of rotation of said feed drum.

5. An apparatus as set forth in claim 4 wherein the first sheet material feed means includes a feed drum having an axis of rotation which is disposed in the horizontal plane containing the axis of rotation of said feed drum in said second sheet material feed means.

6. An apparatus as set forth in claim 1 wherein said plurality of ink jet nozzles includes a first group of ink jet nozzles disposed above the upwardly sloping path segment along which sheet material is moved through said printer means for directing a flow of ink downwardly toward an upwardly facing side of the sheet material and a second group of ink jet nozzles disposed below the upwardly sloping path segment along which sheet material is moved through said printer means for directing a flow of ink upwardly toward a downwardly facing side of the sheet material.

7. An apparatus as set forth in claim 1 further including registration means for engaging a leading end portion of the sheet material as the sheet material is being moved by said conveyor means along an upwardly sloping path segment extending between said second feed drum and said printer means and for effecting relative movement between the sheet material and said conveyor means as the sheet material is being moved by said conveyor means along the upwardly sloping path segment extending between said second feed drum and said printer means to align the sheet material with said printer means.

8. An apparatus for use in feeding sheet material, said apparatus comprising a longitudinally extending collating conveyor, a first rotatable feed drum for engaging a leading end portion of sheet material at a pickup location while the leading end portion of the sheet material is in a first orientation and for feeding the sheet material from the pickup location along an arcuate path toward said collating conveyor during rotation of said first feed drum about a first horizontal axis, sheet material holder means for holding sheet material, a second rotatable feed drum for engaging the leading end portion of sheet material which is at least partially held by said holder means while the leading end portion of the sheet material is in the first orientation and for feeding the sheet material from said holder means along an arcuate path toward said collating conveyor during rotation of said second feed drum about a second horizontal axis, conveyor means for receiving sheet material from said second feed drum and for moving the sheet material to said pickup location with the leading end portion of the sheet material in the first orientation at the pickup location to enable said first feed drum to engage the leading end portion of the sheet material at the pickup location while the leading end portion of the sheet material is in the first orientation, and printer means for printing on the sheet material while the sheet material is being moved by said conveyor means, said conveyor means including means for moving the sheet material away from said second feed drum to said printer means along a first path segment which slopes upwardly away from said second feed drum to said printer means at an acute angle to a horizontal plane, for moving the sheet material through said printer means along a second path segment which slopes upwardly at an acute angle to the horizontal plane, and for moving the sheet material to said pickup location along a third path segment which slopes downwardly away from said printer means toward said first feed drum at an acute angle to a horizontal plane, said printer means including means for directing ink toward the sheet material along flow paths which extend at an acute angle to a vertical plane and which extend perpendicular to the second upwardly sloping path segment along which sheet material is moved through said printer means by said conveyor means.

9. An apparatus as set forth in claim 8 wherein said first axis about which said first feed drum rotates and said second axis about which said second feed drum rotates are disposed in the same horizontal plane.

10. An apparatus as set forth in claim 8 wherein said second path segment along which said conveyor means moves sheet material through said printer means is disposed above a horizontal plane containing said second axis about which said second feed drum rotates.

11. An apparatus as set forth in claim 8 further including registration means for engaging the leading end portion of the sheet material a the sheet material is being moved along the first path segment by said conveyor means and for effecting relative movement between the sheet material and said conveyor means as the sheet material is being moved along the first path segment by said conveyor means to align the sheet material with said printer means.

12. An apparatus as set forth in claim 8 wherein said conveyor means includes a first plurality of belts for engaging an upper side of the sheet material as said conveyor means moves the sheet material along the second path segment and a second plurality of belts for engaging a lower side of the sheet material as said conveyor means moves the sheet material along the second path segment, said means for directing ink toward the sheet material including means for directing ink toward the upper side of the sheet material between belts of said first plurality of belts and means for directing ink toward the lower side of the sheet material between belts of said second plurality of belts, said belts of said first plurality of belts being movable transversely to the second path segment and said belts of said second plurality of belts being movable transversely to the second path segment to enable ink to be directed between the first and second pluralities of belts to different locations on the upper and lower sides of the sheet material.

13. An apparatus as set forth in claim 12 further including registration means for engaging the sheet material and moving the sheet material relative to said first and second pluralities of belts to align the sheet material with said printer means.

14. An apparatus for use in feeding sheet material, said apparatus comprising a longitudinally extending collating conveyor for moving sheet material along a collating conveyor path, a rotatable feed means for engaging sheet material at a pickup location for moving the engaged sheet material away from the pickup station and in the direction of movement of sheet material along the collating conveyor path, and for releasing the sheet material at said collating conveyor while the sheet material is moving in the direction of movement of the sheet material along the collating conveyor path, sheet material holder means for holding sheet material, a rotatable feed drum for engaging the leading end portion of sheet material which is at least partially held by said holder means and for feeding the sheet material from said holder means along an arcuate path toward said collating conveyor during rotation of said feed drum about a horizontal axis, conveyor means for receiving sheet material from said feed drum and for moving the sheet material to said pickup location to enable said rotatable feed means to engage the sheet material at the pickup location, and printer means for printing on the sheet material while the sheet material is being moved by said conveyor means, said conveyor means including means for moving the sheet material away from said feed drum to said printer means along a first path segment which slopes upwardly away from said feed drum to said printer means at an acute angle to a horizontal plane, for moving the sheet material through said printer means along a second path segment which slopes upwardly at an acute angle to the horizontal plane, and for moving the sheet material to said pickup location along a third path segment which slopes downwardly away from said printer toward said first feed drum at an acute angle to a horizontal plane, said printer means including means for directing ink toward the sheet material along flow paths which extend at an acute angle to a vertical plane and which extend perpendicular to the second upwardly sloping path segment along which sheet material is moved through said printer mean by said conveyor means.

15. An apparatus as set forth in claim 14 wherein an axis about which said rotatable feed mean rotates is perpendicular to the axis about which said feed drum rotates.

16. An apparatus as set forth in claim 14 wherein said second path segment along which said conveyor means moves sheet material through said printer means is disposed above a horizontal plane containing the axis about which said feed drum rotates.

17. An apparatus as set forth in claim 14 further including registration means for engaging the leading end portion of the sheet material as the sheet material is being moved along the first path segment by said conveyor means and for effecting relative movement between the sheet material and said conveyor means as the sheet material is being moved along the first path segment by said conveyor means to align the sheet material with said printer means.

18. An apparatus as set forth in claim 14 wherein said conveyor means includes a first plurality of belts for engaging an upper side of the sheet material as said conveyor means moves the sheet material along the second path segment and a second plurality of belts for engaging a lower side of the sheet material as said conveyor means moves the sheet material along the second path segment, said means for directing ink toward the sheet material including means for directing ink toward the upper side of the sheet material between belts of said first plurality of belts and means for directing ink toward the lower side of the sheet material between belts of said second plurality of belts, said belts of said first plurality of belts being movable transversely to the second path segment and said belts of said second plurality of belts being movable transversely to the second path segment to enable ink to be directed between the first and second pluralities of belt to different locations on the upper and lower sides of the sheet material.

19. An apparatus as set forth in claim 18 further including registration means for engaging the sheet material and moving the sheet material relative to said first and second pluralities of belts to align the sheet material with said printer means.

20. An apparatus for feeding sheet material to a first sheet material feed means at a pickup location and from which the sheet material is fed to a longitudinally extending collator conveyor, said apparatus comprising sheet material holder means for holding sheet material, second sheet material feed means for engaging a leading end portion of sheet material which is at least partially held by said holder means while the leading end portion of the sheet material is in a first orientation and for feeding the sheet material from said holder means, said second sheet material feed means including a rotatable feed drum for feeding sheet material along an arcuate path during operation of said second sheet material feed means, conveyor means for receiving sheet material from said feed drum and for moving the sheet material toward the first sheet material feed means, printer means for printing on sheet material while the sheet material is being moved by said conveyor means, said conveyor means including means for moving the sheet material with the indicia printed thereon to the pickup location with the leading end portion of the sheet material in the first orientation at the pickup location to enable the first sheet material feed means to engage the leading end portion of the sheet material at the pickup location while the leading end portion of the sheet material is in the first orientation, said conveyor means including an initial portion which moves the sheet material away from said feed drum to said printer means along an upwardly sloping path length which is skewed at a first acute angle to a horizontal plane, a second portion which moves the sheet material through said printer means along an upwardly sloping path length which is skewed at a second acute angle to a horizontal plane, said second acute angle being smaller than said first acute angle, and a third portion which moves the sheet material away from said second portion of said conveyor means along a downwardly sloping path length to the pickup location.

21. An apparatus as set forth in claim 20 wherein the first sheet material feed means includes a rotatable feed drum for feeding sheet material, said rotatable feed drum in said second sheet material feed means being rotatable about a central axis which is disposed in the same horizontal plane as an axis about which the feed drum in the first sheet material feed means rotates.

22. An apparatus as set forth in claim 20 wherein the first sheet material feed means includes a feed drum which is rotatable about a horizontal axis which is disposed in a horizontal plane containing an axis of rotation of said feed drum in said second sheet material feed means.

23. An apparatus as set forth in claim 22 wherein said initial and third portions of said conveyor means extend through the horizontal plane containing the axes of rotation of said feed drums and the upwardly sloping path length along which said second portion of said conveyor means moves the sheet material is disposed above the horizontal plane containing the axes of rotation of said feed drums.

24. An apparatus for feeding sheet material to a first sheet material feed means at a pickup location and from which the sheet material is fed to a longitudinally extending collator conveyor, said apparatus comprising sheet material holder means for holding sheet material, second sheet material feed means for engaging a leading end portion of sheet material which is at least partially held by said holder means while the leading end portion of the sheet material is in a first orientation and for feeding the sheet material from said holder means, said second sheet material feed means including a rotatable feed drum for feeding sheet material along an arcuate path during operation of said second sheet material feed means, conveyor means for receiving sheet material from said feed drum and for moving the sheet material toward the first sheet material feed means, printer means for printing on sheet material while the sheet material is being moved by said conveyor means, said printer means including a plurality of ink jet nozzles for directing streams of ink toward the sheet material along flow paths extending at acute angles to a vertical plane so that the locations where the ink jets engage the sheet material are offset from centers of the ink jet nozzles, said conveyor means including means for moving the sheet material with the indicia printed thereon to the pickup location with the leading end portion of the sheet material in the first orientation at the pickup location to enable the first sheet material feed means to engage the leading end portion of the sheet material at the pickup location while the leading end portion of the sheet material is in the first orientation, said plurality of ink jet nozzles including a first group of ink jet nozzles disposed above a path along which sheet material is moved through said printer means for directing a flow of ink downwardly toward an upwardly facing side of the sheet material and a second group of ink jet nozzles disposed below the path along which sheet material is moved through said printer means for directing a flow of ink upwardly toward a downwardly facing side of the sheet material, said conveyor means includes a first plurality of belts for engaging an upper side of the sheet material as said conveyor means moves the sheet material and a second plurality of belts for engaging a lower side of the sheet material as said conveyor means moves the sheet material, said first group of ink jet nozzles including means for directing ink toward the upper side of the sheet material between belts of said first plurality of belts, said second group of ink jet nozzles including means for directing ink toward the lower side of the sheet material between belts of said second plurality of belts, said belts of said first plurality of belts being movable transversely to the path of movement of the sheet material and said belts of said second plurality of belts being movable transversely to the path of movement of the sheet material to enable ink to be directed between the first and second pluralities of belts to different locations on the upper and lower sides of the sheet material.

25. An apparatus for use in feeding sheet material, said apparatus comprising a longitudinally extending collating conveyor, a first feed means engaging sheet material at a pickup location and for feeding the sheet material from the pickup location toward said collating conveyor, sheet material holder means for holding sheet material, a second feed means for engaging sheet material which is at least partially held by said holder means and for feeding the sheet material from said holder means, conveyor means for receiving sheet material from said second feed means and for moving the sheet material to said pickup location, and printer means for printing on the sheet material while the sheet material is being moved by said conveyor means, said conveyor means including means for moving the sheet material away from said second feed means through said printer means along a path segment which slopes upwardly at an acute angle to a horizontal plane, and for moving the sheet material to said pickup location along a path segment which slopes downwardly away from said printer means toward said first feed means at an acute angle to a horizontal plane, said printer means including means for directing ink toward the sheet material along flow paths which extend at an acute angle to a vertical plane and which extend perpendicular to the upwardly sloping path segment along which sheet material is moved through said printer means by said conveyor means, said conveyor means including a first plurality of belts for engaging an upper side of the sheet material as said conveyor means moves the sheet material through said printer means and a second plurality of belts for engaging a lower side of the sheet material as said conveyor means moves the sheet material through said printer means, said means for directing ink toward the sheet material including means for directing ink toward the upper side of the sheet material between belts of said first plurality of belts and means for directing ink toward the lower side of the sheet material between belts of said second plurality of belts, said belts of said first plurality of belts being movable transversely to the upwardly sloping path segment and said belts of said second plurality of belts being movable transversely to the upwardly sloping path segment to enable ink to be directed between the first and second pluralities of belts to different locations on the upper and lower sides of the sheet material.

26. An apparatus for feeding sheet material to a first sheet material feed means at a pickup location and from which the sheet material is fed to a longitudinally extending collator conveyor, said apparatus comprising sheet material holder means for holding sheet material, second sheet material feed means for engaging a leading end portion of sheet material which is at least partially held by said holder means while the leading end portion of the sheet material is in a first orientation and for feeding the sheet material from said holder means, said second sheet material feed means including a rotatable feed drum for feeding sheet material along an arcuate path during operation of said second sheet material feed means, conveyor means for receiving sheet material from said feed drum and for moving the sheet material toward the first sheet material feed means, printer means for printing on sheet material while the sheet material is being moved by said conveyor means, said conveyor means including means for moving the sheet material with the indicia printed thereon to the pickup location with the leading end portion of the sheet material in the first orientation at the pickup location to enable the first sheet material feed means to engage the leading end portion of the sheet material at the pickup location while the leading end portion of the sheet material is in the first orientation, said conveyor means including belt means for gripping the sheet material and for moving the sheet material through said printer means, said belt means including a plurality of longitudinally extending belts which engage one side of the sheet material and means for enabling said plurality of belts to be moved toward and away from each other to vary locations where said belts engage the sheet material and thereby enable said printer means to print at any one of a plurality of locations on the sheet material.

27. An apparatus as set forth in claim 26 wherein said printer means includes a plurality of ink jet nozzles for directing streams of ink toward the sheet material along flow paths extending at acute angles to a vertical plane so that the locations where the ink jets engage the sheet material are offset from centers of the ink jet nozzles.

28. An apparatus as set forth in claim 26 further including registration means for engaging the sheet material and moving the sheet material relative to said conveyor means during movement of sheet material toward said printer means by said conveyor means to align the sheet material with said printer means.

29. An apparatus as set forth in claim 26 wherein said belt means moves the sheet material toward said printer means at a first speed, said apparatus further including registration means for engaging a leading end portion of the sheet material and applying force against the leading end portion of the sheet material to reduce the speed of movement of the sheet material from the first speed to a second speed which is slower than the first speed.

30. An apparatus for feeding sheet material to a first sheet material feed means at a pickup location and from which the sheet material is fed to a longitudinally extending collator conveyor, said apparatus comprising sheet material holder means for holding sheet material, second sheet material feed means for engaging a leading end portion of sheet material which is at least partially held by said holder means while the leading end portion of the sheet material is in a first orientation and for feeding the sheet material from said holder means, said second sheet material feed means including a rotatable feed drum for feeding sheet material along an arcuate path during operation of said second sheet material feed means, conveyor means for receiving sheet material from said feed drum and for moving the sheet material toward the first sheet material feed means, printer means for printing on sheet material while the sheet material is being moved by said conveyor means, said conveyor means including means for moving the sheet material with the indicia printed thereon to the pickup location with the leading end portion of the sheet material in the first orientation at the pickup location to enable the first sheet material feed means to engage the leading end portion of the sheet material at the pickup location while the leading end portion of the sheet materials in the first orientation, said conveyor means including a first plurality of conveyor belts for engaging a first side of the sheet material and a second plurality of conveyor belts for engaging a second side of the sheet material, said first and second pluralities of conveyor belts cooperating to grip the sheet material and move the sheet material toward said printer means at a first speed, registration means for engaging a leading end portion of the sheet material while the sheet material is engaged by at least some of the conveyor belts of said first plurality of conveyor belts and at least some of the conveyor belts of said second plurality of conveyor belts to align the sheet material with said printer means by reducing the speed of movement of the sheet material from the first speed to a second speed by establishing slippage between opposite sides of the sheet material and at least some of the conveyor belts of said first and second pluralities of conveyor belts, and means for enabling at least some of the conveyor belts of said first plurality of conveyor belts to be moved transversely to the path of movement of the sheet material through said printer means to enable said printer means to print at any one of a plurality of locations on the first side of the sheet material and for enabling at least some of the conveyor belts of said second plurality of conveyor belts to be moved transversely to the path of movement of the sheet material through said printer means to enable said printer means to print at any one of a plurality of locations on the second side of the sheet material.

31. An apparatus for feeding sheet material to a first sheet material feed means from which the sheet material is fed to a longitudinally extending collator conveyor, said apparatus comprising sheet material holder means for holding sheet material, second sheet material feed means for feeding the sheet material from said holder means, conveyor means for receiving sheet material from said second sheet material feed means and for moving the sheet material toward the first sheet material feed means, and printer means for printing on sheet material while the sheet material is being moved by said conveyor means, said conveyor means includes belt means for gripping the sheet material and for moving the sheet material through said printer means, said belt means including a plurality of longitudinally extending belts which engage one side of the sheet material and means for enabling said plurality of belts to be moved toward and away from each other to vary locations where said belts engage the sheet material and thereby enable said printer means to print at any one of a plurality of locations on the sheet material.

32. An apparatus as set forth in claim 31 wherein said printer means includes a plurality of ink jet nozzles for directing streams of ink toward the sheet material along flow paths extending at acute angles to a vertical plane so that the locations where the ink jets engage the sheet material are offset from centers of the ink jet nozzles.

33. An apparatus as set forth in claim 31 further including registration means for engaging the sheet material and moving the sheet material relative to said conveyor means during movement of sheet material toward said printer means by said conveyor means to align the sheet material with said printer means.

34. An apparatus as set forth in claim 31 wherein said conveyor means moves the sheet material away from said second sheet material feed means through said printer means along an upwardly sloping path length which is skewed at an acute angle to a horizontal plane and moves the sheet material away from said printer means along a downwardly sloping path length toward the first sheet material feed means.

35. An apparatus as set forth in claim 34 wherein the first sheet material feed means includes a first feed drum which is rotatable about a first horizontal axis, said second sheet material feed means including a second feed drum which is rotatable about a second horizontal axis and which is disposed in a horizontal plane containing said first horizontal axis about which said first feed drum rotates.

36. An apparatus for feeding sheet material to a first sheet material feed means from which the sheet material is fed to a longitudinally extending collator conveyor, said apparatus comprising sheet material holder means for holding sheet material, second sheet material feed means for feeding the sheet material from said holder means, conveyor means for receiving sheet material from said second sheet material feed means and for moving the sheet material toward the first sheet material feed means, and printer means for printing on opposite sides of the sheet material while the sheet material is being moved by said conveyor means, a first group of ink jet nozzles disposed above a path along which sheet material is moved through said printer means for directing a flow of ink downwardly toward an upwardly facing side of the sheet material and a second group of ink jet nozzles disposed below the path along which sheet material is moved through said printer means for directing a flow of ink upwardly toward a downwardly facing side of the sheet material, said conveyor means including a first plurality of belts for engaging an upper side of the sheet material as said conveyor means moves the sheet material and a second plurality of belts for engaging a lower side of the sheet material as said conveyor means moves the sheet material, said belts of said first plurality of belts being movable transversely to the path of movement of the sheet material and said belts of said second plurality of belts being movable transversely to the path of movement of the sheet material to enable ink to be directed between the first and second pluralities of belts by said first and second groups of ink jet nozzles to different locations on the upper and lower sides of the sheet material.

37. An apparatus as set forth in claim 36 wherein said first group of ink jet nozzles directs streams of ink downwardly toward the sheet material along flow paths extending a acute angles to a vertical plane so that locations where the ink jets engage the upwardly facing side of the sheet material are offset from centers of the ink jet nozzles, said second group of ink jet nozzles directs streams of ink upwardly toward the sheet material along flow paths extending at acute angles to a vertical plane so that locations where the ink jets engage the downwardly facing side of the sheet material are offset from centers of the ink jet nozzles.

38. An apparatus as set forth in claim 37 wherein said first and second pluralities of belts move the sheet material through said printer means along a path which slopes at an acute angle relative to a horizontal plane.

* * * * *